United States Patent [19]

Lehrer

[11] 4,297,986

[45] Nov. 3, 1981

[54] FORCED AIR FIREPLACE HEATING SYSTEM

[76] Inventor: Joseph E. Lehrer, 3696 S. Hibiscus, Denver, Colo. 80237

[21] Appl. No.: 56,089

[22] Filed: Jul. 9, 1979

[51] Int. Cl.[3] ..... F24B 7/00

[52] U.S. Cl. ..... 126/121; 126/138; 126/120; 237/51

[58] Field of Search ..... 126/121, 120, 138, 139, 126/119, 141, 130, 131, 164, 152 B, 163 R; 237/51

[56] References Cited

U.S. PATENT DOCUMENTS

| | | | |
|---|---|---|---|
| 1,640,771 | 8/1927 | Hannum | 126/121 |
| 1,681,995 | 8/1928 | Miles . | |
| 1,747,259 | 2/1930 | Pierce . | |
| 2,134,935 | 11/1938 | Winnett . | |
| 2,642,859 | 6/1953 | Brown . | |
| 2,829,634 | 4/1958 | Wyatt . | |
| 3,459,173 | 8/1969 | Lydle | 126/138 X |
| 3,955,553 | 5/1976 | Soeffker | 126/121 |
| 3,976,047 | 8/1976 | Breen et al. . | |
| 4,008,704 | 2/1977 | Petrie | 126/121 |
| 4,077,388 | 3/1978 | Whiteley | 126/121 |
| 4,095,581 | 6/1978 | Billmeyer et al. . | |
| 4,103,669 | 8/1978 | Pauley . | |
| 4,112,914 | 9/1978 | Brown . | |
| 4,129,113 | 12/1978 | Bergstrom | 126/121 |
| 4,131,106 | 12/1978 | Rusinek, Jr. et al. | 126/121 |
| 4,170,218 | 10/1979 | Hartley | 126/121 |

*Primary Examiner*—Larry Jones
*Attorney, Agent, or Firm*—John E. Reilly

[57] ABSTRACT

A forced air fireplace heating system for a space to be heated circulates air from the space through a lower horizontal plenum which either surrounds or is placed beneath the fireplace grill, and a series of adjustable tubes extending upwardly and forwardly from the rear of the plenum over the fireplace grill and through a front support into the space. A blower may be connected to either side of the plenum to draw air from the space for the purpose of heating and recirculating air back into the space. The system is self-contained and self-supporting within the fireplace requiring no modification or positive attachment to the fireplace or firebox itself; and accordingly is specifically adaptable for use in combination with a front closure for example of the type having glass doors across the front of the fireplace wherein the plenum extends through a panel section beneath the glass doors and the circulating tubes exit through a panel section above the doors.

11 Claims, 7 Drawing Figures

FORCED AIR FIREPLACE HEATING SYSTEM

This invention relates to a novel and improved heating system for fireplaces and more particularly to an air flow heating system of the recirculating type which can be installed in existing fireplaces as a means of recovering and utilizing the maximum sensible heat from the fireplace and therefore serves as a useful energy conservation device.

BACKGROUND AND FIELD OF THE INVENTION

Various systems have been devised for installation in fireplaces to serve as a means of optimum recovery and utilization of the heat generated and particularly for the purpose of serving as an auxiliary heat source in a space to be heated. For instance it has been proposed in the past to employ a plenum having a series of spaced tubes extending from the plenum with some means of drawing air from the space to be heated through the plenum and over the fireplace grille for heating and recirculation back into the room. Representative of this approach are U.S. Pat. Nos. to Miles 1,681,995; Pierce 1,747,259; Winnett 2,134,935 and Brown 2,642,859. In many cases, such devices are adaptable for pre-existing fireplaces; i.e., can be mounted within the fireplace without substantial reconstruction or modification of the fireplace itself. Others have devised systems which either require positive attachment to the fireplace or modification of the structure of the fireplace itself. For example, U.S. Pat. No. 3,976,047 to Breen et al employs a heat exchanger which includes a radially extending housing having sloped top and bottom walls with air inlet and outlet passages and means for removably mounting the housing above the fireplace hearth such that the rearward end of the air inlet passage is located angularly above the hearth and the apex of the sloped walls defines a flue passage within the rearward wall of the fireplace for expulsion of gases. Other approaches taken have included the use of a forced air circulating system which is usable in combination with a front closure adapted to be placed across the front opening of the fireplace. Representative of this approach is U.S. Pat. No. 4,095,581 to Billmeyer wherein a transparent door seals the open side of the firebox and a housing partially surrounds the firebox to define an air space having a lower inlet and an upper outlet defining the air flow path through the fireplace. The patent to Miles referred to earlier also discloses a circulating system which employs heat resistant doors above the grille and wherein the heated air is circulated through openings in the grille into the room.

While the above and other systems of the type described have met with varying degrees of success, it is highly desirable to provide a fireplace heating system which is conformable for use with fireboxes of varying sizes and not require any positive attachment to the fireplace itself so as to present any difficulties in cleaning or normal use of the fireplace. Further, it is highly desirable that a system of this type be one which is readily usable in open or enclosed fireplaces. For instance, many fireplaces necessitate the use of a front enclosure either as a decorative item or to prevent the entry of smoke into the room. In the past, those systems which have been designed to be self-contained have definite limitations with respect to their utilization in different sized fireplaces and also little in the way of adjustability for example to conform to fireplaces of different depths or heights; or employ a special type of tube structure which must also serve as the log or fuel-supporting portion of the fireplace. Further, those which are adjustable to any extent are not adaptable for use with front enclosures or in most cases require some means of positive attachment to the firebox itself. Representative patents of the type referred to are U.S. Pat. Nos. 4,103,669 to Pauley; 4,112,914 to Brown; and 4,008,704 to Petri.

SUMMARY OF THE INVENTION

It is therefore an object of the present invention to provide for a novel and improved forced air or heated air flow system which is conformable for use with existing fireplaces of different sizes, is self-contained and easily installed within the fireplace without modification of the fireplace.

Another object of the present invention is to provide for a novel and improved heat flow system for fireplaces which is self-contained and can be supplied in kit form with or without a front closure for removable installation into fireplaces of different sizes.

A further object of the present invention is to provide for a forced air circulating system conformable for use with pre-existing fireplaces which employs a combination front closure and heating system having a novel disposition and arrangement of adjustable air flow tubes cooperative with a lower plenum arrangement for recirculation of heated air into a space to be heated.

A still further object of the present invention is to provide for a novel and improved combination front closure and forced air circulating system conformable for use with fireplaces of different sizes which employs a novel means of support and anchoring of the front closure and system with respect to the fireplace and which is comprised of a minimum number of parts adapted to be adjustably connected together while being provided with a novel means of support and anchoring within the fireplace; and further is so constructed and arranged as to facilitate cleaning of the fireplace and affords a clear unobstructed view of the grille and burning fuel while recovering the maximum percentage of sensible heat from the fireplace.

In accordance with the present invention, a novel and improved fireplace heating system has been devised which in its preferred form is made up of a combined front enclosure and forced air heater which are disposed in mutually reinforcing relation to one another so that a minimum number of steps are required to install the system in place within an existing fireplace. Preferably the front enclosure is a glass door enclosure of the type having slidable or foldable glass doors, a lower air intake opening and an upper tube supporting panel or plate. The heater includes a lower plenum of generally U-shaped configuration having opposite sides extending rearwardly from the lower end of the front closure, either side being open-ended to receive the exhaust end of a blower pipe or duct for the delivery of forced air from an external source through the heating system and the opposite side being closed. The plenum is sized to pass around the outside of the grate or grill for the fuel so as to be substantially hidden from view but will support a series of mounting tubes which are positioned in closely-spaced parallel relation to one another preferably around the rear intermediate portion of the plenum and telescopingly receive the lower ends of adjustable forced air circulating tubes. The latter extend upwardly and curve forwardly from the plenum in spaced relation above the fuel supporting grill and have forward exhaust or discharge ends which are slidably supported in an upper panel or plate of the front enclosure. The combined adjustability at each end of the forced air circulating tubes permits the system to readily conform to fireplaces of different depths and heights. The generally U-shaped plenum construction in turn serves both as a base support and source of air at either selected side for the circulating tubes without in any manner interfering with the normal placement of the log-supporting grate. For this purpose, the plenum is provided with leveling elements so as to establish the proper attitude or angle between the plenum, front closure and forced air circulating tubes; and where desired very simple clamping means may be employed on the front closure in order to minimize any tendency of the system to shift or not be fully sealed against the front opening of the fireplace once installed. The front closure itself may be of a standard glass enclosure type, the only modification required being to provide upper openings for slidable projection of the discharge ends of the tubes therethrough and a lower air intake opening to establish communication between the intake end of the plenum and the forced air delivery source. In addition, a lower trap or vent may be formed in the front enclosure merely to facilitate removal of ashes or other products of combustion as well as to adjust the draft or amount of air permitted to pass into the fireplace other than that delivered through the plenum. The system described is further conformable for use without a front enclosure. In this case, the circulating tubes will merely extend upwardly and forwardly as described to direct heated air away from the fireplace into the space to be heated and, in the absence of a front enclosure, upper support means are provided for maintaining the upper discharge ends of the tube in closely-spaced parallel relation to one another so as not to be subject to misalignment or displacement.

Other objects, advantages and features of the present invention will become more readily appreciated and understood when taken together with the following detailed description in conjunction with the accompanying drawings, in which:

DETAILED DESCRIPTION OF THE PREFERRED EMBODIMENT

Figure 1:
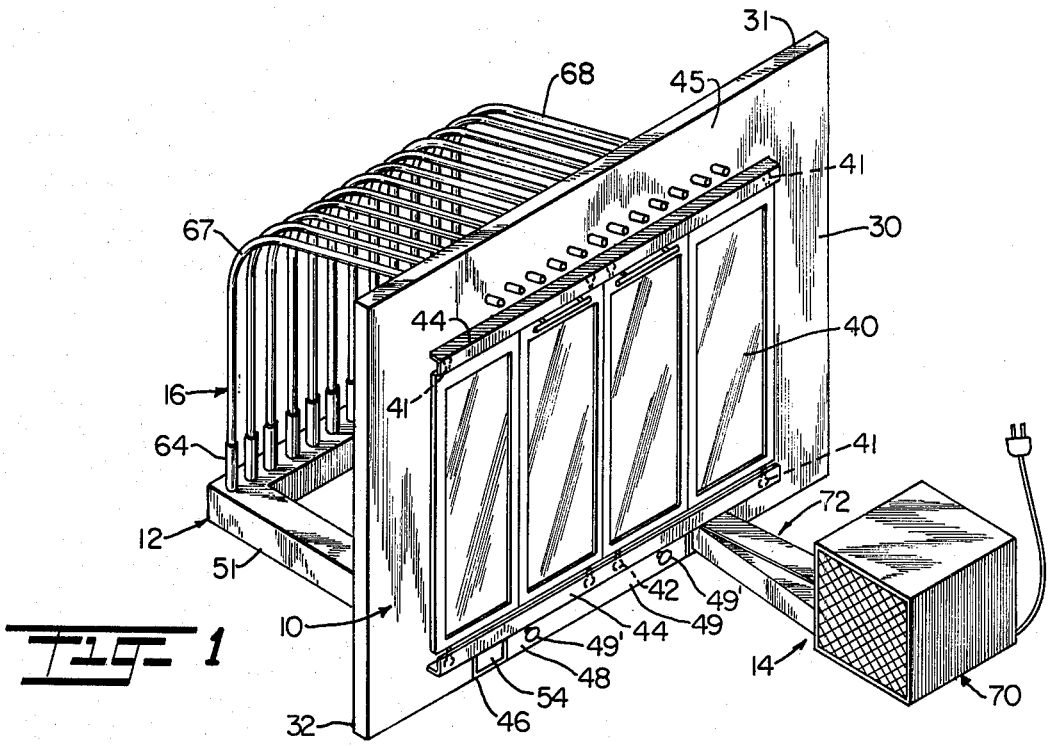
FIG. 1 is a perspective view of a preferred embodiment of the present invention.
Figure 2:
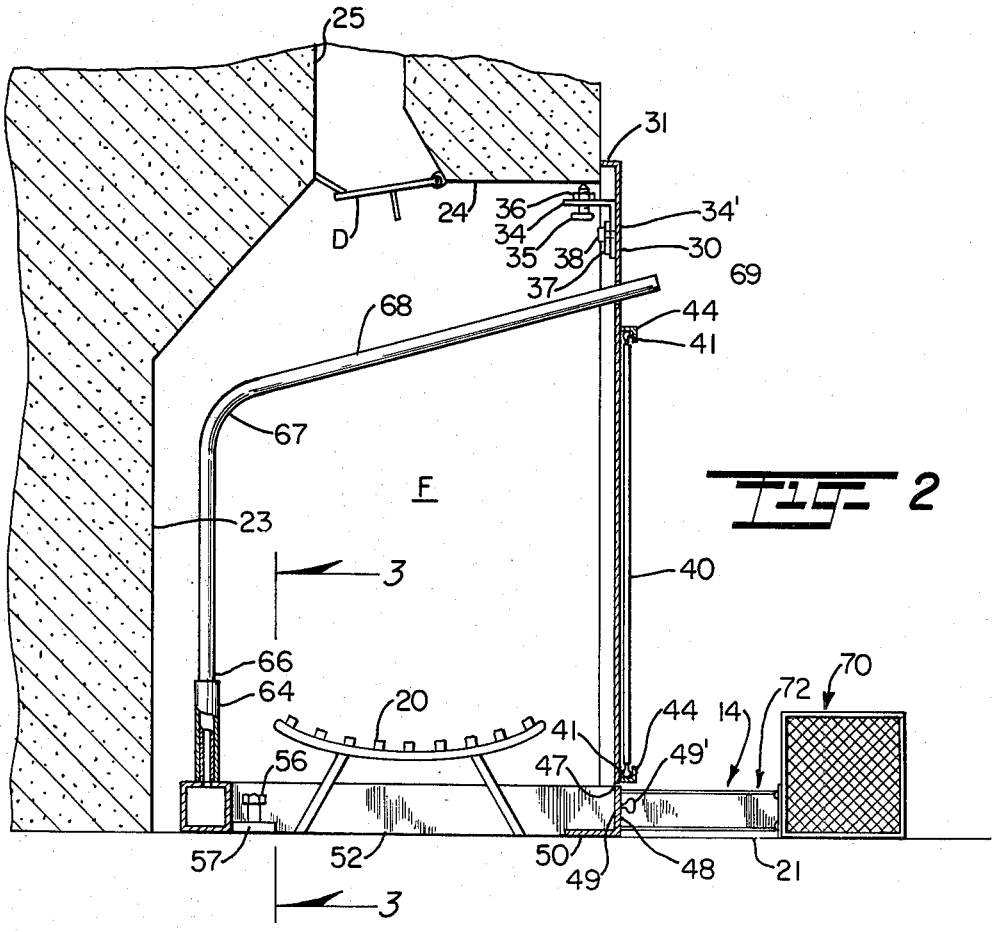
FIG. 2 is a elevational partially in section view illustrating the installation of the preferred form of invention within a firebox.

Referring in more detail to the drawings, the preferred form of the present invention, as shown in FIGS. 1 to 5, is broadly comprised of a front fireplace enclosure panel 10, a plenum 12 extending rearwardly from the lower end of said front panel 10, an air delivery section 14 to deliver air under pressure into the plenum, and a plurality of forced air circulating tubes 16 which extend upwardly from the rearward end of the plenum 12 and curve forwardly for projection through the upper part of the front panel 10. As a preliminary to describing the invention in more detail and to serve more as a setting for the present invention, its installation in a conventional fireplace F is illustrated in FIG. 2. The fireplace F may conventionally be in the form of an open firebox having a hearth 21, upon which is disposed a fuel-support grate 20, opposite sidewalls 22 and a rear wall 23. The upper wall of the firebox conventionally includes a lintel 24 and in a well-known manner the upper wall of the fireplace is designed to extend upwardly into a flue 25 there being suitable means such as a damper mechanism at the entrance or approach to the flue to regulate the opening and closing of the fireplace into the flue area.

In the preferred form, the front enclosure panel 10 is sized to overlap somewhat the front opening of the firebox and, as illustrated in FIGS. 1 and 2, is of generally rectangular construction having a main plate 30 of relatively heavy duty construction provided with upper and lower horizontally and rearwardly projecting flanges or lips 31 and 32, respectively. A pair of horizontally spaced brackets are positioned on the rear face of the panel directly beneath the upper flange 31 so as to project rearwardly in spaced relation between the upper flange, one of the brackets 34 being illustrated in FIG. 2 and having a threaded bore for insertion of a mounting screw therethrough. The mounting screw is provided with a lock nut 36 and is threaded upwardly through the bracket so as to be threadable into engagement with the lintel of the fireplace.

The panel 30 is provided with an enlarged central opening to accommodate foldable glass doors 40 which for example may be of the type having outer hinges 41 and inner slide projections 42 slidable through upper and lower horizontal guide channels 44 so that the doors 40 may be folded away from the closed position as illustrated in FIG. 1 to a fully open position affording access to the interior of the firebox. Customarily, the central opening is of a size approximating the opening size of the fireplace for convenient access into the firebox for the purpose of placing fuel, building a fire or controlling the damper. The glass doors 40 are positioned intermediately between an upper tube-supporting section or area designated at 45 and a lower recessed area 46 for the lower plenum 12 and air delivery section 14, although in actual practice the panel is of one-piece construction as described with the glass doors 40 being mounted across the central opening of the panel as described.

The lower recessed section 46 of the front panel is slotted beneath the substantial length of the lower guide channel 44, there being a downwardly projecting ledge 47 which forms the upper edge of the recessed or slotted area 46. A trap or drawer 48 is positioned in the recessed area 46 so as to abut the upper ledge 47 directly beneath the channel 44. As illustrated the drawer 48 comprises a front vertical panel 49 and a rearwardly extending, lower horizontal plate 50 which projects rearwardly from the lower edge of the panel 47 to rest upon the surface of the hearth. A pair of knobs 49' on the front panel 49 of the drawer facilitate movement of the drawer 48 between a flush position with the ledge 47 and a removed or ajar position in which the panel can be drawn away from the plane of the main panel 30 either for clean-out purposes or to regulate the amount of air permitted to flow into the firebox from the lower portion of the panel enclosure when the glass doors are closed. In other words, the drawer serves both as a clean out trap and as a vent for the fireplace.

The preferred form of plenum 12 is defined by a duct of generally U-shaped configuration having opposite sides or legs 51 and 52 joined together by a rearward intermediate duct section 53. One leg 51 extends rearwardly from the recessed portion 46 of the front panel and has a normally closed end plate 54. The opposite leg 52 extends rearwardly from the recessed portion 46 and has an open end or air intake portion as at 55 for communication with the air delivery section 14. The plenum duct sections are preferably rectangular in cross-section and are permitted to rest independently of the front panel enclosure on the hearth or floor surface of the firebox. Being of generally U-shaped configuration, opposite legs 51 and 52 will extend rearwardly from the opposite ends of the recessed area 46 at opposite ends of the drawer 48 to extend along opposite sides of the grate 20. The intermediate section 53 will extend along the back wall of the firebox rearwardly of the grate. Since the plenum is not directly attached to the front panel enclosure and rests directly upon the hearth, it is desirable to provide leveling members in order to compensate for any uneveness or minor variations in the hearth surface so that the plenum can be properly positioned with respect to the front panel enclosure. For this purpose, leveling screws 56 are threadedly disposed in brackets 57 on the inner surfaces of opposite legs 51 and 52 of the plenum adjacent to the intersection of the rearward intermediate section 53 with the legs. It will be evident that threaded adjustment of the screws 56 through the brackets 57 will permit the plenum to be properly leveled as well as to afford a firm footing for the plenum upon the hearth.

Figure 3:
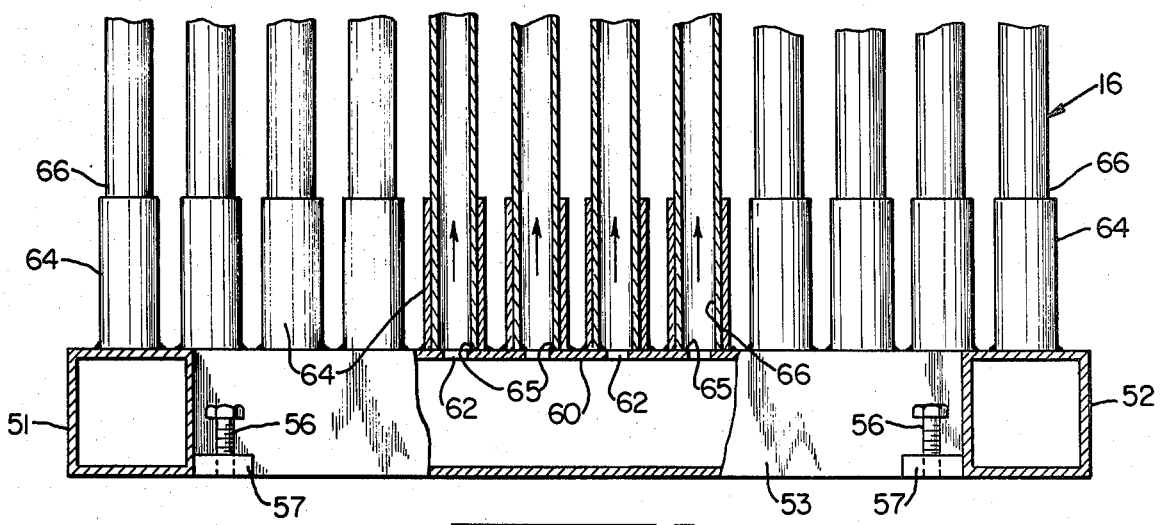
FIG. 3 is a cross-sectional view taken about lines 3—3 of FIG. 2.

Referring in detail to the construction of the intermediate section 53 of the plenum, as shown in FIG. 3, a top horizontal wall 60 is provided with a series of openings 62 at equally spaced intervals along the length of the wall 60, and a corresponding series of mounting tubes 64 are welded or otherwise permanently attached to the top wall surface, each tube being aligned over an opening but being enlarged with respect to an opening so as to leave an inner shoulder 65 at the entrance to the opening itself. The mounting tubes facilitate adjustable or telescoping disposition of the forced air circulating tube 16. Thus as shown in FIG. 3, each tube 16 has a lower end 66 adapted for telescoping insertion through a mounting tube until the bottom extremity of the lower end of the tube abuts against the shoulder 65 in surrounding relation to an opening 62. Preferably each forced air circulating tube 16 is of uniform diameter throughout and is dimensioned to extend upwardly or vertically from its connection to a mounting tube, then to undergo a forward curvature as at 67 into a gradually upwardly sloping, substantially horizontal section 68. Each upper section 68 projects forwardly over the plenum section 12 and terminates in a forwardly projecting discharge end 69 which extends through an aperture in the upper support portion 40 of the front panel enclosure 30.

Figure 4:
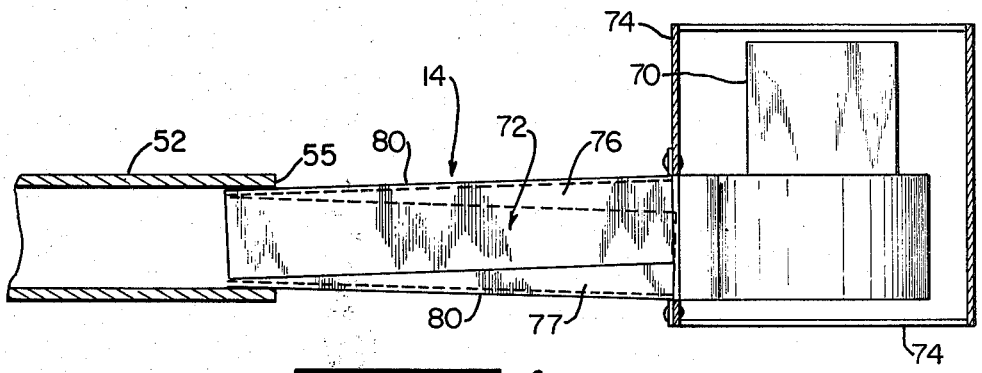
FIG. 4 is a vertical sectional view enlarged of the air delivery or intake portion of the preferred embodiment of the present invention.
Figure 5:
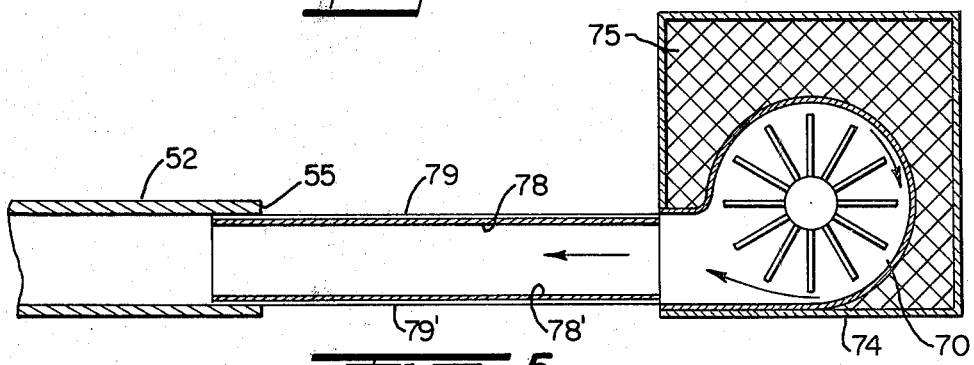
FIG. 5 is a horizontal section enlarged of the air delivery section of the preferred embodiment of the present invention.

As illustrated in more detail in FIGS. 4 and 5, the air delivery section 14 comprises an air blower 70 and discharge duct 72, the latter being adapted for insertion into the open end 55 of the leg 52. The blower may conventionally be a constant speed unit designed for heating or cooling purposes, such as, a Model 4C004A or 4C446 unit manufactured by Dayton Electric Manufacturing Co. of Chicago, Illinois. The blower is mounted in a rectangular housing 74 having an inlet side 75 and a discharge opening in communication with the duct 72. Preferably the duct 72 is made up of a pair of longitudinally extending complementary U-shaped channels 76 and 77 which have top wall sections 78, 78' and bottom wall sections 79, 79', respectively, adapted to interfit in telescoping relation to one another, and opposite vertical sidewalls 80 interconnect the pair of top and bottom walls of each channel 76 and 77. As shown in top view of FIG. 4, the complementary duct sections or channels are horizontally slidable toward and away from one another to decrease or increase, respectively, the duct opening size from the blower into the intake 55 of the plenum and to gradually reduce the opening size of the duct from the blower into the plenum.

The plenum 12 as designed permits interconnection of the air-delivery section 14 into either leg 51 or 52 of the plenum depending upon space requirements in front of the fireplace. Whichever side is employed, the other side is closed by the end plate 54. The end plate 54 is sized to substantially cover the end of the leg but to permit a small amount of air leakage so as not to permit undue pressure build-up as the plenum air becomes heated. In practice, utilization of a plurality of relatively thin-walled tubes 16 extending from the rear of the plenum will generate a high volume rate of air flow over a wide area of the space to be heated. The plenum is sized to extend across the substantial width of the firebox with the tubes 16 extending entirely across the width of the upper wall section of the plenum. For instance, by employing twelve tubes each on the order of $\frac{5}{8}''$ in diameter, a total approximate area of 2' of air flow is provided.

Figure 6:
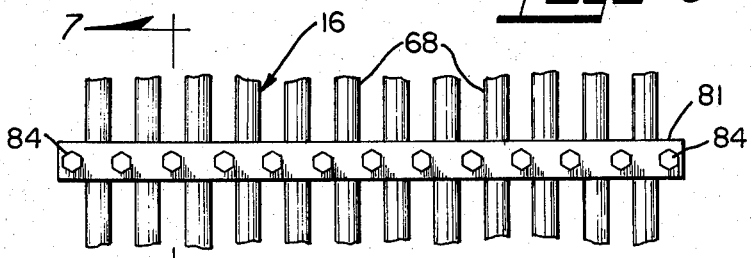
FIG. 6 is a somewhat fragmentary plan view illustrating the disposition and arrangement of a bracing unit for interconnecting the circulating tubes in a modified form of the present invention.
Figure 7:
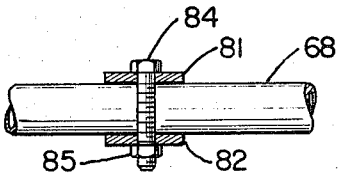
FIG. 7 is a cross-sectional view taken about lines 7—7 of FIG. 6.

An optional feature of the present invention resides in the use of the preferred form of invention without a front enclosure or panel 30. As shown in FIGS. 6 and 7, the only desirable modification or addition is to employ a tube support or brace assembly 80 across the upper or forward ends of the tubes in the absence of the tube support portion of the panel 30. The assembly 80 may comprise upper and lower plates 81 and 82 secured together transversely across the top and undersurfaces of the tubes 16, for example, as shown in FIGS. 6 and 7. The plates 81 and 82 are secured by connecting members suitably in the form of bolts 84 extending vertically through aligned openings in the plates between adjacent tubes, and lock nuts 85 when tightened securely clamp the plates to the tubes. The bracing as described will avoid shifting or misalignment of the tubes when in use. In either form, the heating system of the present invention is easily broken down into kit form so as to facilitate packaging and transportation. Thus, the only assembly steps required are to insert the circulating tube 16 into the mounting tube 64, position the plenum and assemble tubes in place within the firebox and return the grate to its normal position. The front enclosure is then placed over the entrance to the fireplace with the discharge ends of the tube 16 being inserted through the openings across the upper end of the panel 30. The forward ends of the plenum are centered or aligned with respect to the recessed area 46, and the drawer 48 positioned across the recessed area between opposite sides of the plenum. The air delivery section 14 is aligned with either side of the plenum 12 which is to serve as the intake end, and the discharge duct 72 is adjusted for insertion into that end. The other end of the plenum is then closed by the end plate 54.

Of course, in those installations where the front panel enclosure is not utilized, the brace structure 80 can be installed over the tubes if desired to maintain their alignment. Although the present invention has been described with particularity relative to the foregoing detailed description of the preferred embodiment, various modifications, changes, additions and applications other than those specifically mentioned herein will be readily apparent to those having normal skill in the art without departing from the spirit and scope of this invention.

I claim:

1. A heating system adapted for installation in a fireplace wherein said fireplace includes a firebox communicating with an upper flue and a lower fuel-supporting member positioned in said firebox, said system comprising:

(1) a lower, substantially horizontally extending plenum disposed around the lower periphery of said firebox;

(2) air-delivery means communicating with said plenum;

(3) a plurality of forced air circulating tubes extending upwardly in closely-spaced relation from communication with said plenum and extending substantially horizontally over said fuel-supporting member toward the entrance to said firebox, said tubes terminating in open-ended exhaust portions at the entrance to said firebox whereby air delivered to said plenum by said air-delivery means is forced through said tubes in heat exchange relation to the heat generated in said fireplace for discharge through said open-ended exhaust portions; and (4) said plenum being of generally U-shaped configuration having opposite sides extending rearwardly away from the entrance to said fireplace with one side projecting rearwardly from the entrance to said firebox along one side of said fuel-supporting member and having an air intake end on said one side communicating with said air-delivery means, an intermediate portion extending between the rearward ends of opposite sides of said plenum, opposite sides of said plenum having open ends, one of said open ends being in communication with said air delivery means, and a removable closure across the other of said open ends.

2. A heating system adapted for installation in a fireplace wherein said fireplace includes a firebox communicating with an upper flue and a lower fuel-supporting grate is positioned in said firebox, said system comprising:

(1 ) a lower, substantially horizontally extending plenum disposed in at least partially surrounding relation to said fuel-supporting grate, said plenum being of generally U-shaped configuration having opposite sides with one side projecting rearwardly from the entrance to said firebox along one side of said fuel-supporting grate and having an air intake end on one side communicating with said air-delivery means;

(2 ) air-delivery means communicating with said plenum from a location external of said firebox; opposite sides of said plenum having open ends, one of said open ends being in communication with said air delivery means, and a removable closure across the other of said open ends.

(3 ) a plurality of thin-walled forced air circulating tubes extending upwardly at closely-spaced intervals from communication with said plenum and extending substantially horizontally over said fuel-supporting grate toward the entrance to said firebox, said tubes terminating in open-ended exhaust portions at the entrance to said firebox whereby air delivered to said plenum by said air-delivery means is forced through said tubes in heat exchange relation to the heat generated in said fireplace for discharge through said open-ended exhaust portions.

3. A heating system according to claim 2, said plenum being in the form of a duct of generally rectangular cross-section having opposite sides extending rearwardly away from the entrance to said fireplace along the bottom surface thereof and an intermediate portion extending between the rearward ends of opposite sides of said plenum, a plurality of mounting tubes projecting upwardly from said intermediate section corresponding in number to the number of forced air circulating tubes, said forced air circulating tubes having lower ends sized for disposition in telescoping relation to said mounting tubes on the intermediate section of said plenum.

4. A heating system adapted for installation in a fireplace wherein said fireplace includes a firebox communicating with an upper flue and a lower fuel-supporting member positioned in said firebox, said system comprising:

(1 ) a lower, substantially horizontally extending plenum disposed around the lower periphery of said firebox;

(2 ) air-delivery means communicating with said plenum;

(3 ) a plurality of forced air circulating tubes extending upwardly in closely-spaced relation from communication with said plenum and extending substantially horizontally over said fuel-supporting member toward the entrance to said firebox, said tubes terminating in open-ended exhaust portions at the entrance to said firebox whereby air delivered to said plenum by said air-delivery means is forced through said tubes in heat exchange relation to the heat generated in said fireplace for discharge through said open-ended exhaust portions; and (4 ) said plenum being of generally U-shaped configuration having opposite sides extending rearwardly away from the entrance to said fireplace with one side projecting rearwardly from the entrance to said firebox along one side of said fuel-supporting member and having an air intake end on said one side communicating with said air-delivery means, an intermediate portion extending between the rearward ends of said opposite sides of said plenum, said plenum including a plurality of mounting tubes projecting upwardly from said intermediate section corresponding in number to the number of forced air circulating tubes, said forced air circulating tubes having lower ends sized for disposition in telescoping relation to said mounting tubes on the intermediate section of said plenum, each of said mounting tubes defining a central opening into the interior of said plenum, an internal shoulder disposed within each of said mounting tubes, and the lower end of each of said forced air circulating tubes being adapted for insertion in a respective mounting tube.

5. A heating system according to claim 4, said plenum provided with vertically adjustable leveling members at spaced intervals thereon.

6. A heating system according to claim 4, said plenum having a forwardly extending air intake end, and said air-delivery means including a discharge duct adapted to be disposed in telescoping relation to the air intake end of said plenum.

7. A heating system according to claim 4, said air delivery means having a discharge duct of adjustable cross-sectional size.

8. A combination fireplace enclosure and heating system conformable for installation as a self-contained unit in an existing firebox of the type having a front opening and a grate to support fuel for combustion with the products of combustion rising upwardly through said firebox into an upper flue, the combination in which:

said enclosure is defined by a panel sized to cover the front opening of said firebox, an upper circulating tube support portion, a lower plenum support portion having air intake means therein and access doors intermediately between said upper and lower support portions, said heating system comprising a plenum extending horizontally from said air intake means around the lower portion of said firebox in surrounding relation to said grate, a plurality of mounting tubes projecting in spaced parallel relation from said rear intermediate section of said plenum, air circulating tubes extending upwardly from said plenum over said grille and projecting forwardly through said upper tube support portion, each of said mounting tubes defining a central opening into the interior of said plenum, an internal shoulder disposed within each of said mounting tubes, and the lower end of each of said forced air circulating tubes being adapted for insertion in a respective mounting tube, and a blower disposed externally of said enclosure to deliver air through said air intake means in said circulating tubes.

9. A combination fireplace enclosure and heating system according to claim 8, said air circulating tubes being adjustably disposed with respect to said mounting tubes and with respect to said upper circulating tube support portion.

10. A combination fireplace enclosure and heating system according to claim 8, said front enclosure having rearwardly extending clamping means operative to clampingly engage the inner walls of said firebox.

11. A combination fireplace enclosure and heating system according to claim 8, said plenum provided with vertically adjustable leveling members at spaced intervals thereon, said plenum independently supported on the hearth of said fireplace with opposite sides of said plenum extending through an intermediate recessed area beneath said doors.

* * * * *